US007014475B1

(12) United States Patent
Mongold

(10) Patent No.: US 7,014,475 B1
(45) Date of Patent: Mar. 21, 2006

(54) EDGE MOUNT ELECTRICAL CONNECTOR

(75) Inventor: John A. Mongold, Middletown, PA (US)

(73) Assignee: Samtec, Inc., New Albany, IN (US)

( * ) Notice: Subject to any disclaimer, the term of this patent is extended or adjusted under 35 U.S.C. 154(b) by 0 days.

(21) Appl. No.: 10/985,358

(22) Filed: Nov. 10, 2004

(51) Int. Cl.
*H01R 12/00* (2006.01)

(52) U.S. Cl. ..... 439/67

(58) Field of Classification Search ..... 439/67, 439/77, 492–499
See application file for complete search history.

(56) References Cited

U.S. PATENT DOCUMENTS 4,755,147 A * 7/1988 Young ..... 439/77
5,161,986 A * 11/1992 Gulbranson et al. ..... 439/92
5,163,835 A * 11/1992 Morlion et al. ..... 439/67
5,409,384 A * 4/1995 Green et al. ..... 439/67
5,472,349 A 12/1995 Dixon et al.
5,742,484 A * 4/1998 Gillette et al. ..... 361/789
5,813,871 A 9/1998 Grabbe et al.
5,860,814 A 1/1999 Akama et al.
5,971,773 A * 10/1999 Riddle ..... 439/67
6,231,355 B1 5/2001 Trammel et al.
6,652,318 B1 11/2003 Winings et al.
6,688,897 B1 2/2004 Korsunsky et al.
6,692,273 B1 2/2004 Korsunsky et al.

* cited by examiner

*Primary Examiner*—Ross Gushi
(74) *Attorney, Agent, or Firm*—Keating & Bennett, LLP

(57) ABSTRACT

An edge mount electrical connector assembly includes a flexible circuit having a first end for connecting to one major surface of the circuit board and a second end for connecting to another major surface of the circuit board, and an electrical connector connected to the flexible circuit in between the first and the second ends of the flexible circuit.

23 Claims, 11 Drawing Sheets

EDGE MOUNT ELECTRICAL CONNECTOR

BACKGROUND OF THE INVENTION

1. Field of the Invention

The present invention relates to electrical connectors and more specifically, the present invention relates to an edge mount mezzanine array connector and an edge mount backplane array connector.

2. Description of the Related Art

Electrical connectors are used to place electrical devices, such as printed circuit boards, in communication with one another. An electrical connector may be thought of as having two portions, one portion of which connects to a first electrical device and the second portion of which connects to a second electrical device to be put into communication with the first device. To connect the two devices, the two portions of the electrical connector are mated together.

Each portion of the connector includes one set of contacts or terminals adapted to communicatively couple to an electronic device and a second set of contacts or terminals adapted to matingly couple to the other connector portion. This can be readily accomplished by designating one portion of the connector as having "male" contacts or terminals adapted to couple to the other connector portion's "female" contacts or terminals. Regardless of the specifics of the design of the contacts or terminals, the two connector portions should be adapted to be easily connected and disconnected from each other to respectively electrically link and unlink the electrical devices to which they are connected.

Accordingly, each connector portion is fixedly connected to an electronic device through its remaining set of contacts or terminals. The contacts or terminals may be removably or permanently connectable to the electrical device; however, it is usually desired that the connector portion be secured to the electrical device through some physical mechanism. Typically, the connector portions are secured to electrical devices by fusing the contacts or terminals to contact pads or the like formed on the electrical device.

Recently, there has been a trend toward miniaturization of most electrical devices. As electrical devices become smaller and more complex, the electrical connectors used with these devices must also become smaller and must be able to accommodate the more complex devices. One problem with miniaturized electrical connectors arises from the increased precision of placement necessary to produce the proper positioning and connection of the connector contacts or terminals onto the device. This problem is exacerbated by the ever-increasing input/output (I/O) density requirements demanded of the progressively smaller electrical connectors by increasingly miniaturized electrical devices. With increased pin counts (e.g., greater number of terminals) in each connector, it becomes more and more difficult to maintain desired levels of co-planarity while maintaining contact of all of the terminals to a substrate or PCB.

One means of addressing the need for increased I/O density is to provide an array connector. Such an array connector can provide a high-density two-dimensional array of contacts or terminals for interfacing with an electrical device. However, array connectors present attachment difficulties regarding connection to devices (i.e., circuit boards or substrates) since most of the contacts or terminals must necessarily be positioned in the interior of the two-dimensional array area and are accordingly difficult to align upon connection, visually inspect, and/or repair.

Other types of connectors are also known and used for connection to a printed circuit board (PCB). For example, "board edge" connectors or "straddle mount" connectors, which are straddle-mounted to an edge of a PCB and has a common ground member for rows of signal conductors installed inside of the connectors to connect with the pads disposed on or both sides of the PCB, are known. See, for example, U.S. Pat. Nos. 5,472,349; 6,231,355; 6,692,273; and 6,688,897.

For such connectors, through-hole mounting technology has been used. Mounting portions of the terminals are placed in through holes of the PCB and held in place by soldering or some type of mechanical engagement of the pin with sidewalls of the through hole. As the need for high density of the connector increased, the number of through holes required also increased. However, since the diameter of the through holes is relatively large, only a limited number of through holes could be provided in a given area. Therefore, through-hole technology could not meet the requirement for high density applications. In addition these through holes negatively affect the electrical performance of the connector.

In order to provide for a higher density of connectors on the board, surface mount technology has been utilized. Examples of surface mount connectors can be found in U.S. Pat. No. 5,813,871 and U.S. Pat. No. 5,860,814. Because no through holes are required, conductive pads on the printed circuit board can be closely spaced, thereby allowing a connector with condensed terminals to be mounted in an area of the board which would be impossible for a through-hole version.

As the progression toward higher density continues, it has become imperative that every possible area of the printed circuit board be effectively utilized. A straddle mount connector located on an edge of the printed circuit board was then developed to occupy a minimal board area. Additionally, with the trend of high-speed signal transmission, vertical straddle mount connectors and right angle connectors generally use a ground bus to provide a ground reference to signal contacts for improved signal integrity at higher speeds.

The solder tails of the straddle mount connector wipe the solder paste off of the pads of the printed circuit board when the connector is assembled with the printed circuit board (see, for example, FIG. 1 of U.S. Pat. No. 6,692,273). The solder tails on the straddle mount connector need to be forgiving enough to accept the large tolerance range of the printed circuit board thickness. That is, if the solder tail gap is too large and the printed circuit board is too small, then proper soldering will not occur. Further, in many cases the forces associated with mating and unmating the straddle mount connector are directly transferred to the solder joints on the printed circuit board, which can result in fractured solder joints.

It is also known to use a right angle connector, as shown in FIG. 12. This type of right angle surface mount connector can be used for an array connector or a backplane connector. As is seen in FIG. 12, a PCB 600 must have a plurality of holes 610 formed therein to accommodate tails 652*a* of the contacts 652 of the right angle connector 650.

The tails 652*a* of the contacts 652 are typically compliant pins that provide electrical connections to the printed circuit board 600. The compliant pins 652*a* in right angle backplane connectors adversely affect signal integrity because they require the large diameter plated thru holes 610 to be formed in the printed circuit board. These large plated thru holes 610 require large anti pads to be placed in the ground planes of the printed circuit board, which also adversely affect the signal integrity.

When the compliant pins 652*a* are inserted into the plated thru holes 610, many problems may occur. In many cases, non-symmetrical forces associated with mating and unmating the right angle surface mount connector 650. Further, the right angle surface mount connector sits on just one side of the printed circuit board so that the mating and unmating forces are offset from the centerline of the thickness of the PCB, causing them to be non-symmetrical.

Coplanarity of the SMT solder tails on a high density right angle surface mount connector can be very difficult to control, which results in improper soldering of the right angle surface mount connector. The right angle surface mount connector's weight distribution will cause the connector to sit incorrectly on the PCB during the soldering process, which will cause improper soldering. Also, in many cases, non-symmetrical forces associated with mating and unmating the right angle surface mount connector 650 are directly transferred to the solder joints on the printed circuit board which can result in fractured solder joints.

As can be determined from FIG. 12 (and FIG. 1 of U.S. Pat. No. 6,652,318), when the right angle connector is assembled to the PCB, significant forces are required to insert the compliant pins 652 into the plated holes 610, and the other ends 652*b* of the contacts 652 must be attached to another PCB or electrical device as seen FIG. 1 of U.S. Pat. No. 6,652,318, which causes non-symmetric forces.

Furthermore, up until this time, it has always been required that the ends 652*a* of the terminals 652 of a full density right angle connector be routed to a single side of a PCB, such as PCB 600.

SUMMARY OF THE INVENTION

To overcome the problems described above, preferred embodiments of the present invention provide an improved edge mount electrical connector including a flexible circuit that eliminates all of the above-described problems with conventional connectors.

According to a preferred embodiment of the present invention, a connector assembly preferably includes a flexible circuit having a first end for connecting to one major surface of the circuit board and a second end for connecting to another major surface of the circuit board and an electrical connector connected to the flexible circuit in between the first and the second ends of the flexible circuit.

The flexible circuit is preferably a flexible printed circuit having fusible conductive members thereon. The fusible conductive members are preferably solder balls for connecting the flexible printed circuit to the electrical connector and the circuit board. The electrical connector connected to the flexible circuit in between the first and second ends of the flexible circuit is preferably an array type connector.

The connector assembly also preferably includes a first stiffener attached to the first end of the flexible printed circuit, and a second stiffener attached to the second end of the flexible printed circuit.

The connector assembly also preferably includes a connector frame and a cover having at least one cantilever for applying a force to at least one of the first and second stiffeners. In a preferred embodiment, a plurality of cantilevers is provided so as to apply forces to the first and second stiffeners so as to move the stiffeners toward each other when a printed circuit board is moved into the connector frame. The force applied by the at least one cantilever is approximately zero after reflow of the solder balls.

The connector frame preferably includes circuit board guides for guiding the circuit board.

Also, at least one of the first and the second stiffeners includes blocks arranged to locate and guide the respective stiffener in a connector frame.

In addition, at least one of first and second stiffeners preferably includes at least one pin for insertion into a corresponding alignment hole in the circuit board.

Further, at least one of the first and the second stiffeners preferably includes a standoff for engaging a major surface of the circuit board and for maintaining a minimum distance between the stiffener and the circuit board.

The electrical connector assembly also preferably includes a connector frame for holding the first and the second stiffeners and the flexible circuit and the electrical connector that is connected to the flexible circuit in between the first and the second ends of the flexible circuit. The connector frame preferably includes at least one spreader for spacing the first and the second stiffeners apart until deflected by the circuit board. Alternatively, at least one spring for providing a force to one of the first stiffener and the second stiffener may be provided.

The electrical connector assembly may also include a cover surrounding the flexible circuit and the electrical connector. The cover preferably includes at least one flange for connecting the cover to the circuit board, wherein the at least one flange is preferably soldered to the circuit board. Alternatively, the cover is attached to the circuit board by one of a screw and a bolt. The cover also preferably includes at least one cantilever for providing a force to at least one of a first stiffener attached to the first end of the flexible printed circuit and a second stiffener attached to the second end of the flexible printed circuit. The cover is preferably made of metal but could be made of plastic or other suitable material.

Furthermore, instead of solder balls as the fusible conductive elements, compression connectors may be attached to the flexible circuit for connecting the flexible circuit to the circuit board.

The flexible circuit and the first and the second stiffeners are free to float within the connector frame when the first end of the flexible circuit is connected to the one major surface of the circuit board and the second end of the flexible circuit is connected to the another major surface of the circuit board.

The electrical connector assembly is preferably one of an edge mount mezzanine array connector and an edge mount backplane array connector.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the present invention will now be described with reference to FIGS. 1–11C, which provides a completely different and totally new configuration for an edge mount electrical connector.

Figure 1:
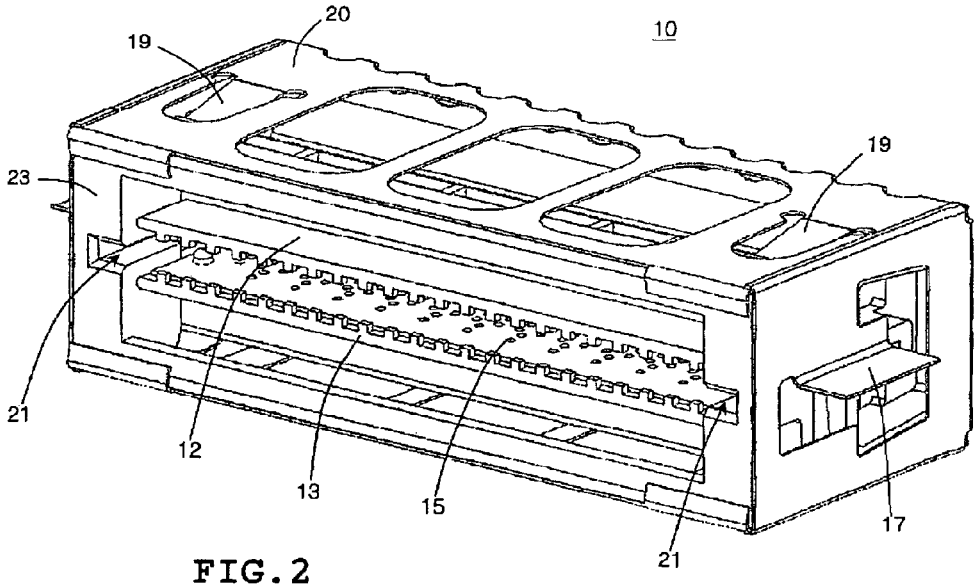
FIG. 1 is an isometric view of the connector assembly according to the first preferred embodiment of the present invention.

FIG. 1 shows a connector assembly 10 according to the first preferred embodiment of the present invention. FIG. 1 shows the connector assembly 10 in an assembled state and FIG. 2 and FIG. 3 show a connector subassembly 30 of the connector assembly 10.

Figure 2:
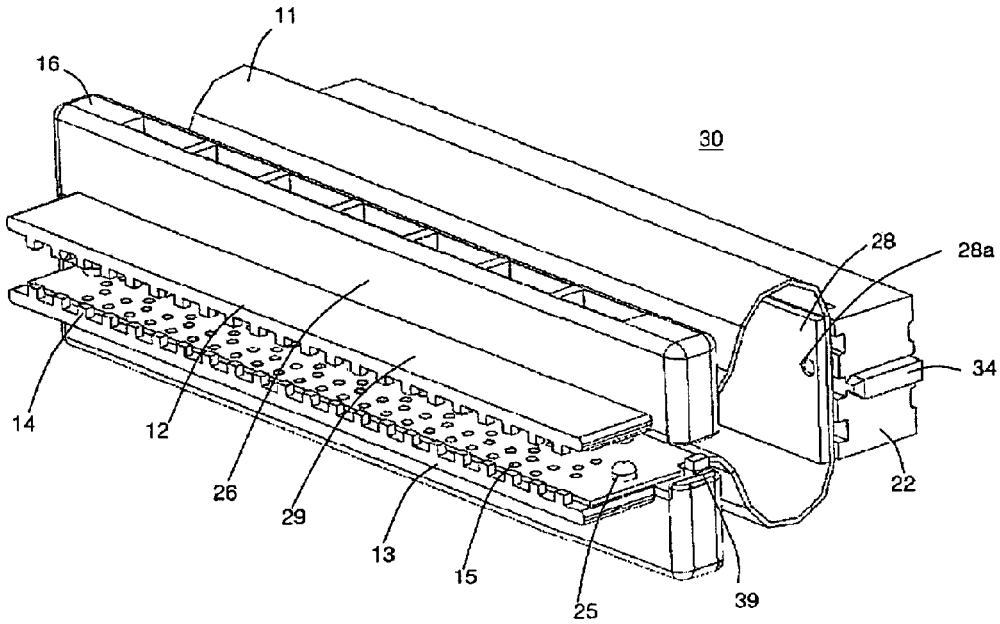
FIG. 2 is an isometric view of a connector subassembly included in the connector assembly of FIG. 1 according to the first preferred embodiment of the present invention.

As is seen in FIG. 2, the connector subassembly of the connector assembly 10 preferably includes a flexible circuit 11 and an array connector 22 connected to the flexible circuit 11. A substantially central portion of the flexible circuit 11 is physically and electrically connected to the array connector 22 along a portion of a first surface of the flexible circuit 11, and ends of the flexible circuit 11 are arranged opposite to each other and spaced away from the array connector 22, such that end portions of a second surface of the flexible circuit, which second surface is opposite to the first surface, face each other. This arrangement causes the flexible circuit 11 to have a substantially U-shaped configuration. The first surface at the substantially central portion of the flexible circuit 11 and the second surface at the ends of the flexible circuit 11 include a plurality of fusible conductive elements 15, such as solder balls, which are preferably made of fusible conductive material and are used for electrical connection to the connector 22 and a circuit board.

Figure 3:
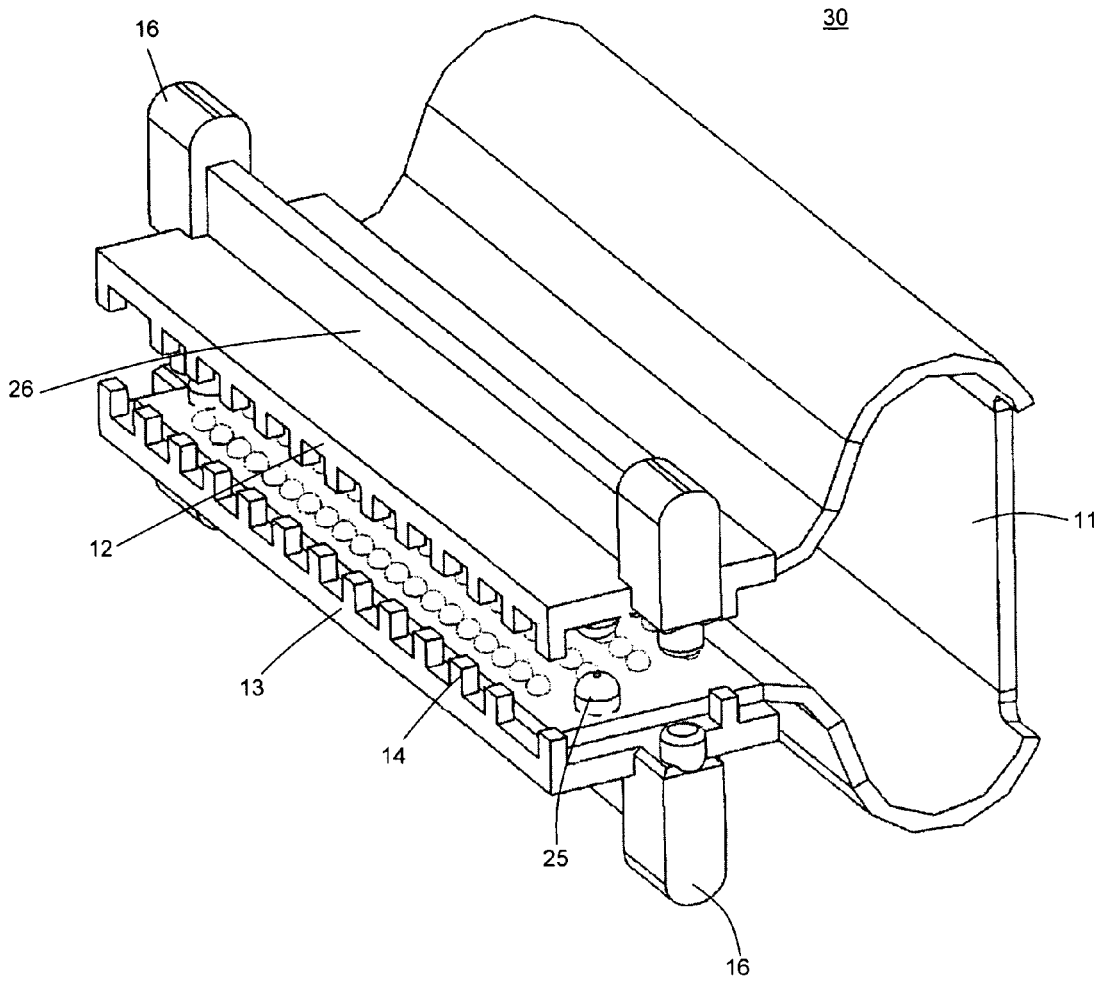
FIG. 3 is an isometric view of the connector subassembly of FIG. 2 in a partially assembled state according to the first preferred embodiment of the present invention.

A first stiffener 12 and a second stiffener 13 are attached to the opposite ends of the flexible circuit 11 as seen most clearly in FIG. 3. The stiffeners 12 and 13 are preferably attached to the flexible circuit 11 by adhesives or other suitable means. Both the first stiffener 12 and the second stiffener 13 preferably include a support portion 29 having a spine 26 and blocks 16. The spine 26 is preferably provided to increase the rigidity of support surface 29.

Figure 4A:
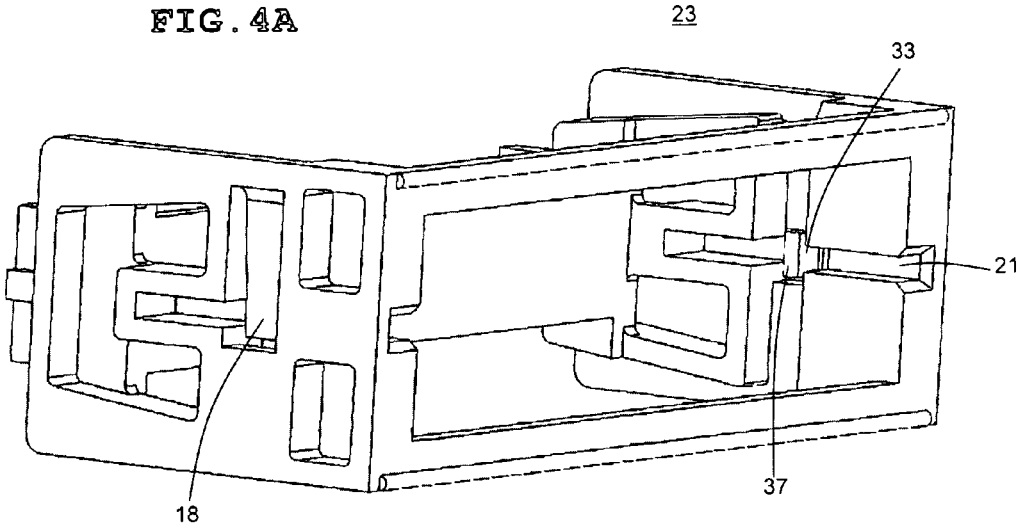
FIGS. 4A and 4B are front and back, respectively, isometric views of a connector frame included in the connector assembly according to the first preferred embodiment of the present invention.
Figure 4B:
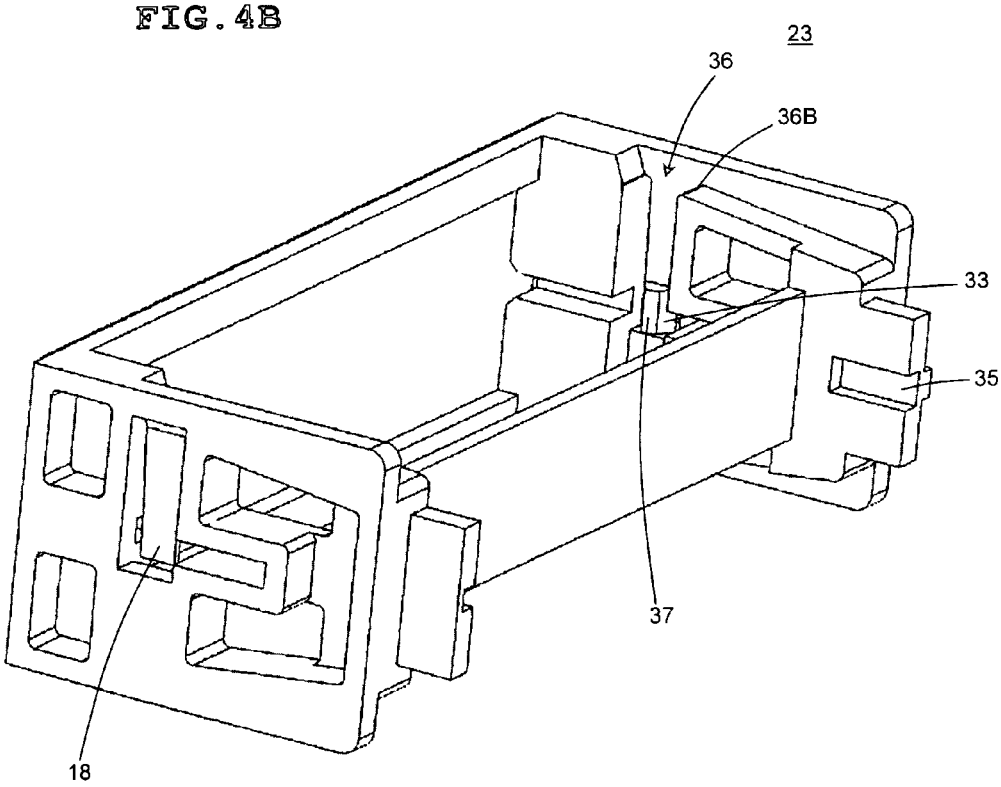
Figure 7:
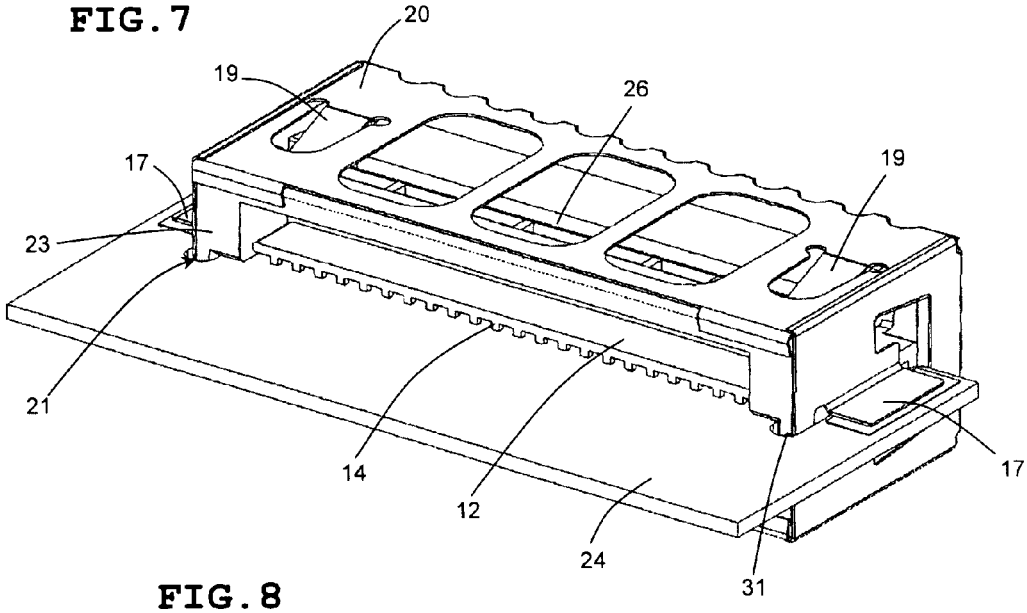
FIG. 7 is an isometric view of the connector assembly and circuit board according to the first preferred embodiment of the present invention.

As can be seen in FIG. 3, the blocks 16 are preferably provided at ends of the spine 26. As will be described later, the blocks 16 are arranged to locate and guide the first and second stiffeners 12 and 13 in a connector frame 23, which is shown in FIGS. 4A and 4B. As can be seen in FIG. 4B, the connector frame 23 includes block guides 36 for locating and guiding the blocks 16, and circuit board guides 21 for locating and guiding the circuit board or PCB 24, as seen in FIG. 7.

The first stiffener 12 and the second stiffener 13 also preferably include standoffs 14 arranged along an outer edge thereof such that the standoffs 14 of the first and second stiffeners 12, 13 face each other and are spaced from each other so as to allow the printed circuit board or PCB 24 to be inserted therebetween. The first and second stiffeners 12, 13 also preferably include alignment pins 25 located at longitudinal ends of the stiffeners 12, 13. The standoffs 14 are arranged to maintain a predetermined distance between a circuit board 24 (shown in FIG. 7) and the first and second stiffeners 12 and 13 during the attachment of the connector assembly 10 to the circuit board 24. The alignment pins 25 are used to engage holes (not shown) in the circuit board 24 so that each of a plurality of fusible conductive elements 15 contacts a corresponding conductive pad (not shown) disposed on the circuit board 24, which results in the flexible circuit 11 being electrically connected to the circuit board 24.

As seen in FIG. 1, a cover 20 can also be provided in the connector assembly 10 and includes cantilevers 19 that force the first and second stiffeners 12, 13 towards each other such that fusible conductive members 15 contact respective conductive pads on the circuit board 24. This will be described in more detail later.

The fusible conductive elements 15 are preferably solder balls for connecting the connector flexible circuit 11 to the circuit board 24 because solder balls 15 allow for greater coplanarity and connector misalignment. That is, the solder balls 15 can be off center or misaligned relative to the conductive pads provided on the circuit board 24 by a greater distance than with other termination types. The solder balls 15 will drop down or flatten when the flexible circuit 11 is forced down onto the circuit board 24 by the cantilevers 19, which will be described later. As can be seen in FIG. 3 especially, the solder balls 15 extend below the standoffs 14 on the first and second stiffeners 12 and 13 before the connector assembly 10 is subjected to a reflow process. When the force of the cantilevers 19 is applied to the first and second stiffeners 12 and 13 during the reflow process, the solder balls 15 will become molten and drop until the standoffs 14 stop the first and second stiffeners 12 and 13 from compressing the solder balls 15. That is, attaching the connector assembly 10 to the circuit board 24 is much more forgiving of positional misalignment and circuit board thickness variations because of the use of solder balls 15.

Preferably, half of the fusible conductive members 15 are arranged at one end of the flexible circuit 11 where the first stiffener 12 is located, and the other half of the fusible conductive members 15 are arranged at the other end of the flexible circuit 11 where the second stiffener 13 is located. By this arrangement, the total number of flexible circuit layers is reduced, which reduces the cost of the flexible circuit 11, improves the flexibility of the flexible circuit 11, and improves signal integrity of the flexible circuit 11. However, the present invention is not limited to this arrangement and other configurations of the fusible conductive members 15 and flexible circuit 11 are possible.

Instead of solder balls 15, compression type interfaces could also be used. In such an arrangement, either additional cantilever beams (not shown) or screws (not shown) are preferably used to force the first and second stiffeners 12 and 13 against the circuit board 24. In addition, a layer of compressible material (not shown) preferably in the form of bumps could be provided between the flexible circuit 11 and the first and second stiffeners 12 and 13. The compressible bumps are preferably formed in the flexible circuit 11, for example, in the form of a solder member made of copper. The compressible bumps include a compressible material between the stiffener 12 or 13 and the flexible circuit 11 that provides normal force when compressed.

As mentioned above, the connector assembly 10 also includes an electrical connector 22, preferably in the form of an array connector, which is attached in the approximate center of the flexible circuit 11 in between the first stiffener 12 and second stiffener 13. The electrical array connector 22 is attached to the first surface of the flexible circuit 11 at the approximate center thereof, as shown in FIG. 2.

A support 28 is preferably attached to the second surface of the flexible circuit 11 at the approximate center thereof for providing rigidity to the flexible circuit 11 along a portion thereof where the electrical connector 22 is attached to the flexible circuit 11. The support 28 is preferably attached to the flexible circuit by adhesive or other suitable means, for example, at location 28*a*.

The electrical connector 22 is preferably attached to the flexible circuit 11 by a solder joint between the electrical connector 22 and conductive pads provided on the first surface at the substantially central portion of the flexible circuit 11. It is preferable to use high temperature lead or lead free solder to attach the electrical connector 22 to the flexible circuit 11. This will aid in attaching the connector assembly 10 to the circuit board 24 during a reflow process.

It is possible to use a cap to cover the connector assembly 10 to shield the connector assembly 10 from the reflow temperatures to avoid reflowing the solder joints in the connector assembly 10 a second time.

The electrical connector 22 can also be attached to the flexible circuit 11 by other connector attachment methods such as other welding methods, compression fits, or press fits.

Once the flexible circuit 11, first and second stiffeners 12, 13 and other elements shown in FIG. 3 have been assembled and the connector 22 has been attached to the flexible circuit to form the subassembly 30 shown in FIG. 2, the subassembly 30 is mounted in the connector frame 23 shown in FIGS. 4A and 4B.

As seen in FIG. 4B, the connector frame 23 includes rail guides 35 for locating and guiding the rails 34 (FIG. 2) of electrical connector 22. The electrical connector 22 is preferably attached to the connector frame 23 by sliding the rail 34 into the rail guide 35 on each end of the connector frame 23 and then heat staking the electrical connector 22 into the connector frame 23. In addition to heat staking, other welding methods, compression fits, press fits could also be used to hold the electrical connector 22 in the connector frame 23.

FIG. 1 shows this assembled state of the connector assembly 10 including the connector frame 23 and the combined structure of the subassembly 30 shown in FIG. 2 mounted therein, for providing an edge mounting to a circuit board according to the first preferred embodiment of the present invention. More specifically, the connector assembly 10 of this preferred embodiment of the present invention preferably includes the subassembly 30 shown in FIG. 2, the connector frame 23, and the cover 20. It should be noted that the cover 20 may or may not be provided in the connector assembly 10, as desired.

The connector frame 23 preferably includes circuit board guides 21 shown in FIG. 4A which fit in circuit board guide slots 31 formed in the circuit board 24 for guiding the circuit board 24 of FIG. 7 so that the fusible conductive members 15 disposed on ends of the flexible circuit 11 at the first stiffener 12 and the second stiffeners 13 can be reliably and accurately aligned with the respective conductive pads disposed on the circuit board 24.

Figure 12:
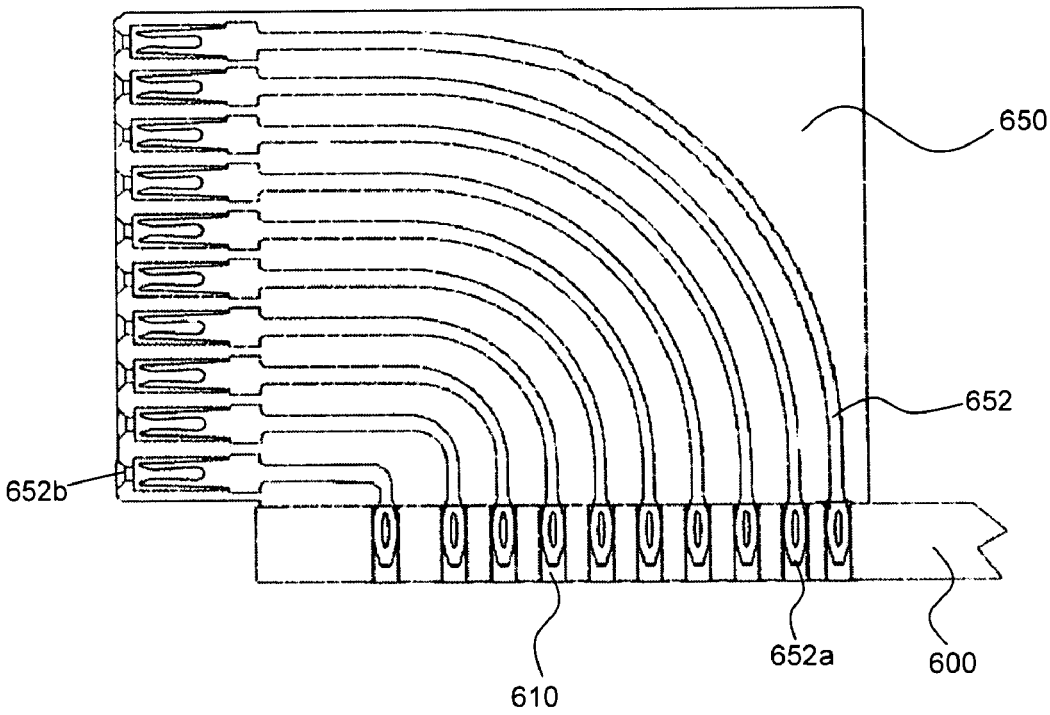
FIG.12 PRIOR ART
FIG. 12 is a view of a conventional right angle connector mated with a printed circuit board.

As can be seen from FIG. 7, the circuit board 24 is inserted into the opening between the first and second stiffeners 12, 13 such that the circuit board slots 31 engage the guides 21 of the frame 23, and such that the leading edge of the circuit board 24 having the conductive pads is located between the first and second stiffeners 12, 13. This results in the conductive pads on the circuit board 24 being accurately positioned relative to the respective fusible conductive elements 15. As will be described in more detail below, the cantilevers 19 are used to force the first and second stiffeners 12, 13 toward each other such that the fusible conductive elements 15 on the ends of the flexible circuit 11 contact the respective conductive members disposed on the circuit board 24. Thus, no compliant pin connections or large-diameter plated through holes in the circuit board, such as those used in FIG. 12, are required to be used in preferred embodiments of the present invention.

It should be noted that if the cover 20 is not used, either a spring or cantilever beam could be added to the stiffener block guides 36 to provide the forces provided by the cantilevers 19.

The signal integrity of the circuit board 24 is improved because the large-diameter plated through holes throughout the circuit board are eliminated. Instead, the circuit board 24 only has much smaller via holes that do not have to accommodate and receive a compliant pin. These much smaller-diameter via holes improve the signal integrity of the circuit board 24. In addition, some of the pads on the circuit board 24 may be routed to the top exposed layer of the circuit board 24, which will reduce the number of layers in the circuit board 24.

FIG. 7 shows the connector 30 and the connector frame 23 attached to a circuit board 24 with the cover 20. As can be seen in FIG. 7, the circuit board 24 may include notches 31 for accommodating the sides of the cover 20, if a cover 20 is used.

As can be seen in FIGS. 1 and 7, the cover 20 surrounds the connector frame 23 in order to protect the connector subassembly 30 and is preferably made of metal but could be made of other materials such as plastic. The cover 20 preferably includes a flange 17 for securing the connector assembly 10 to the circuit board 24. Preferably, the flange 17 is soldered to the circuit board 24 as shown in FIG. 7, but can be attached by other methods and means.

When the connector assembly 10 is secured to the circuit board 24, most, if not all, of the mechanical stresses are eliminated from the solder joints between the fusible conductive members 15 of the connector subassembly 30 and the conductive pads of the circuit board 24 because the first and second stiffeners 12 and 13 are free to float in the connector frame 23. This free floating is possible because of the cantilever 19 bottoming out on a ledge 36B of the connector frame 23, shown in FIG. 4B. When the cantilever 19 bottoms out on the ledge 36B, the connector subassembly 30 has already dropped to the circuit board 24, so all forces are removed from the solder joints between the connector subassembly 30 and the circuit board 24.

The cover 20 preferably includes a plurality, e.g., four, cantilevers 19, two on top of the cover 20 and two on the bottom of the cover 20 (not shown). The cantilevers 19 apply a force to the top of guide blocks 16 on the first and second stiffeners 12 and 13 in a direction that is substantially perpendicular to the surface of the cover 20.

As seen in FIGS. 4A and 4B, the connector frame 23 may also preferably include spreader beams 18, which may include a spreader 37 for keeping the first and second stiffeners 12 and 13 apart until the circuit board 24 is inserted into the connector assembly 10. The separation between the first and second stiffeners 12 and 13 is created by the top and bottom surfaces of the spreader 40 (FIG. 5) resting on the top and bottom surfaces 39 (FIG. 2) of the first and second stiffeners 12 and 13. When no circuit board is inserted into circuit board guide 21, the top of spreader 37 keeps the first stiffener 12 from being pushed down and the bottom of spreader 37 keeps the second stiffener 13 from being pushed up. When a circuit board 24 is inserted into circuit board guide 21, the inside edge of the circuit board slots 31 first engages a beveled edge 33 of the spreader 37 and then deflects the spreader beam 18, on both ends of the frame 23.

Figure 5:
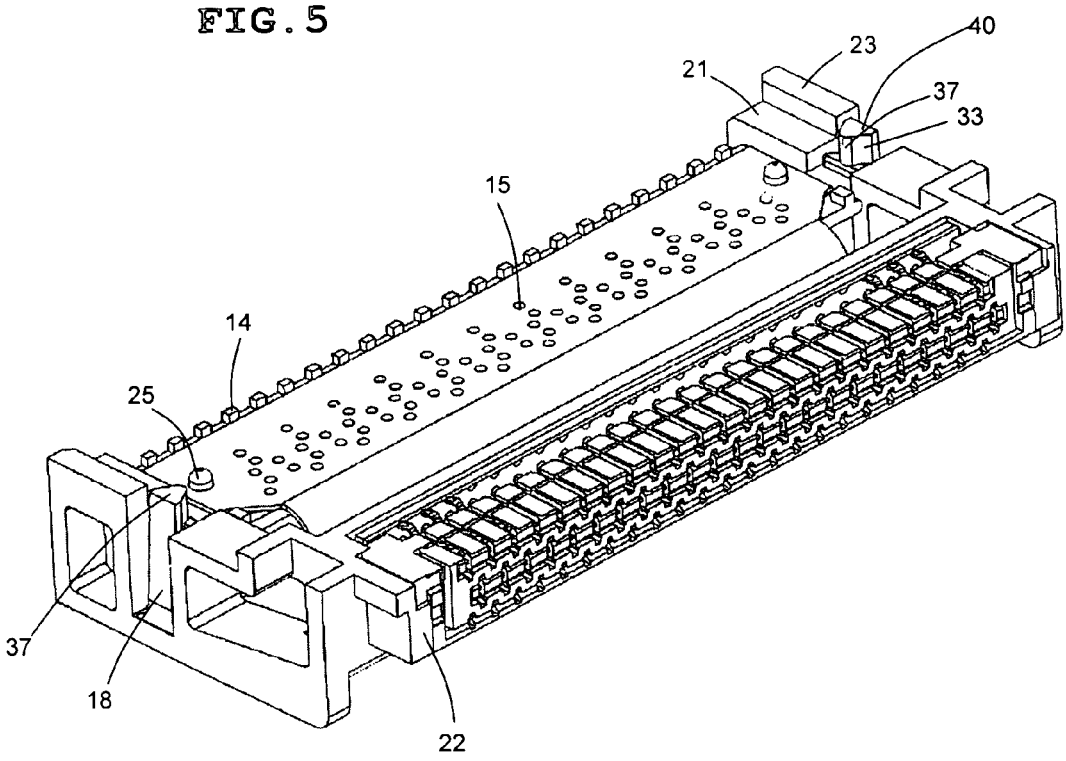
FIG. 5 is a sectional view of the connector frame and the connector subassembly of the connector assembly according to the first preferred embodiment of the present invention.
Figure 6:
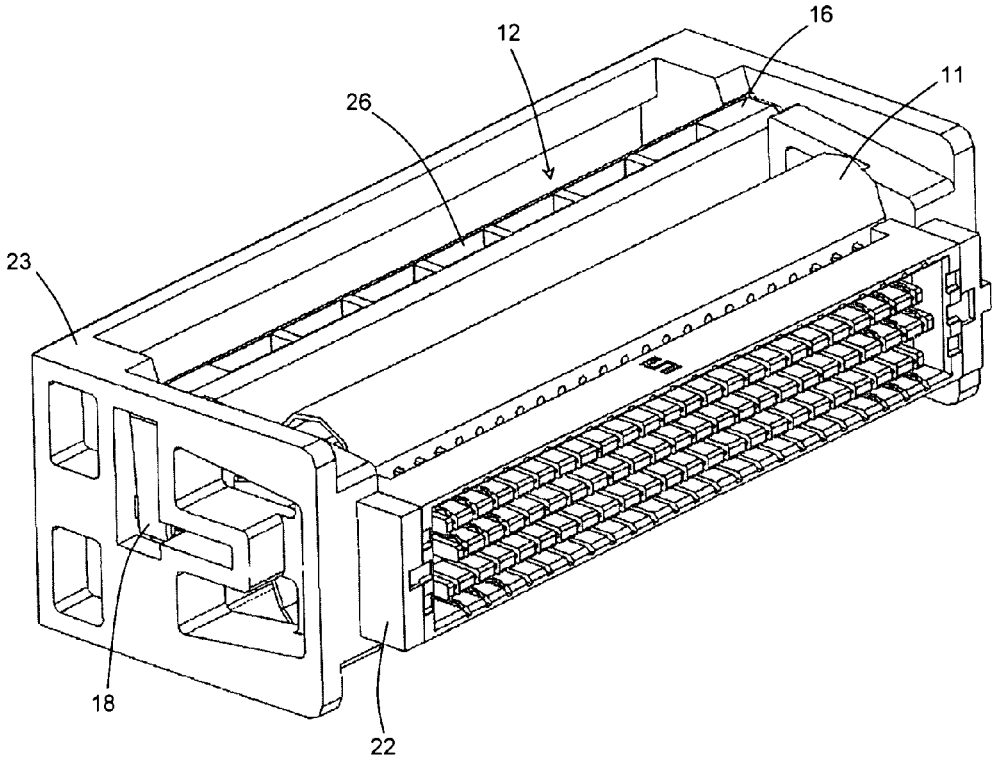
FIG. 6 is an isometric view of the connector frame and the connector subassembly of the connector assembly according to the first preferred embodiment of the present invention.

As can be seen from FIG. 5, a bottom portion of the spreader 37 engages the top of the guide block 16 of the first stiffener 12. The first and second stiffeners 12 and 13 are caused to drop onto the surface of the circuit board 24 when the spreader beams 18 are deflected by the leading edge of the circuit board 24. By keeping the fusible conductive elements 15 disposed on the ends of the flexible circuit 11 attached to the first and second stiffeners 12 and 13 away from the conductive pads of the conductive pads of the circuit board 24 during the insertion of the circuit board 24, the wiping or smearing of the conductive material of the fusible conductive elements 15 on the flexible circuit 11 is reliably prevented and the resulting problems are eliminated, and minimal or no stresses are applied to joints between the fusible conductive elements 15 and the conductive pads of the circuit board 24 during the insertion of the circuit board 24.

The first and second stiffeners 12 and 13 are pressed down by the cantilevers 19 so that the alignment pins 25 of the first and second stiffeners 12 and 13 engage respective holes in the circuit board 24 when the circuit board 24 is fully inserted into the circuit board guide 21. During a reflow process, the cantilevers 19 press down on the first 12 and second 13 stiffeners until the standoffs 14 contact the surface of the circuit board 24, thereby maintaining a minimum predetermined distance between the first 12 and second 13 stiffeners and the surface of the circuit board 24.

After the reflow process, the cantilevers 19 provide no or very little force to the first and second stiffeners 12 and 13. That is, no significant or non-negligible force is applied to the solder joints between the connector subassembly 30 and the circuit board 24 by the cantilevers 19.

With this unique construction, numerous significant advantages are achieved. As noted above, since the first and second stiffeners are spaced apart from each other by a distance that is much greater than the thickness of the circuit board until the leading edge of the circuit board has penetrated a certain amount into the connector, the problems with wiping and smearing of conductive paste during insertion of the circuit board into the connector assembly are eliminated. Also, there are no problems with stress and non-symmetric forces being applied to the connectors, flexible circuit or printed circuit board during mating and unmating thereof. Further, the problems with using compliant pins at the tails of the connector terminals and large-diameter plated holes in the circuit board to receive such compliant pins are eliminated since these elements are not necessary in the connector assembly of the present invention. In addition, this unique construction and totally different mating and unmating structure allows for much larger thickness tolerances of the printed circuit board and improves the circuit board footprint signal integrity performance. Also, this unique construction eliminates all non-negligible forces or stress on solder joints between the printed circuit board and the connector subassembly.

The present invention is not limited to the preferred embodiments described above. Many alternative preferred embodiments are possible.

The flexibility of flexible circuit 11 can be improved by modifying the flexible circuit 11 so that portions of the ground plane of the flexible circuit 11 are removed so as to form slits or openings in the flexible circuit 11. Such portions removed from the flexible circuit 11 allow for additional heated air to flow onto the back side of the first and second stiffeners 12, 13 and be applied to the fusible conductive elements 15 during a reflow process, so as to improve and speed up the reflow connection process. This is shown in more detail in the alternative preferred embodiment of FIG. 8.

Figure 8:
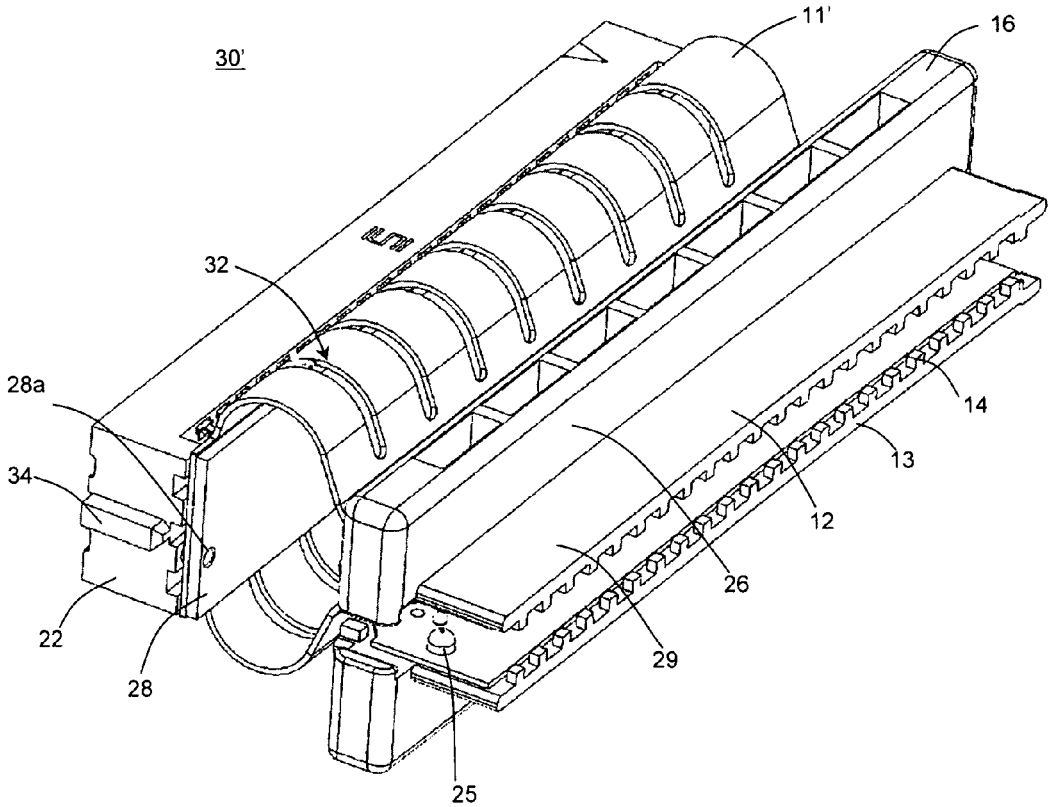
FIG. 8 is an isometric view of a modification of the connector assembly according to an alternative preferred embodiment of the present invention.

As shown in FIG. 8, the flexible circuit 11' of the connector subassembly 30' is modified so that holes or slits 32 are formed in and through the flexible circuit 11' in order to increase the air flow to the fusible conductive elements 15 that are partially shielded by the flexible circuit 11' during a reflow process. The additional hot air flow helps heat and melt the fusible conductive elements 15 that are partially shielded by the flexible circuit 11'. Heat management is also improved by shortening the cooling times of the solder joints.

Figure 9:
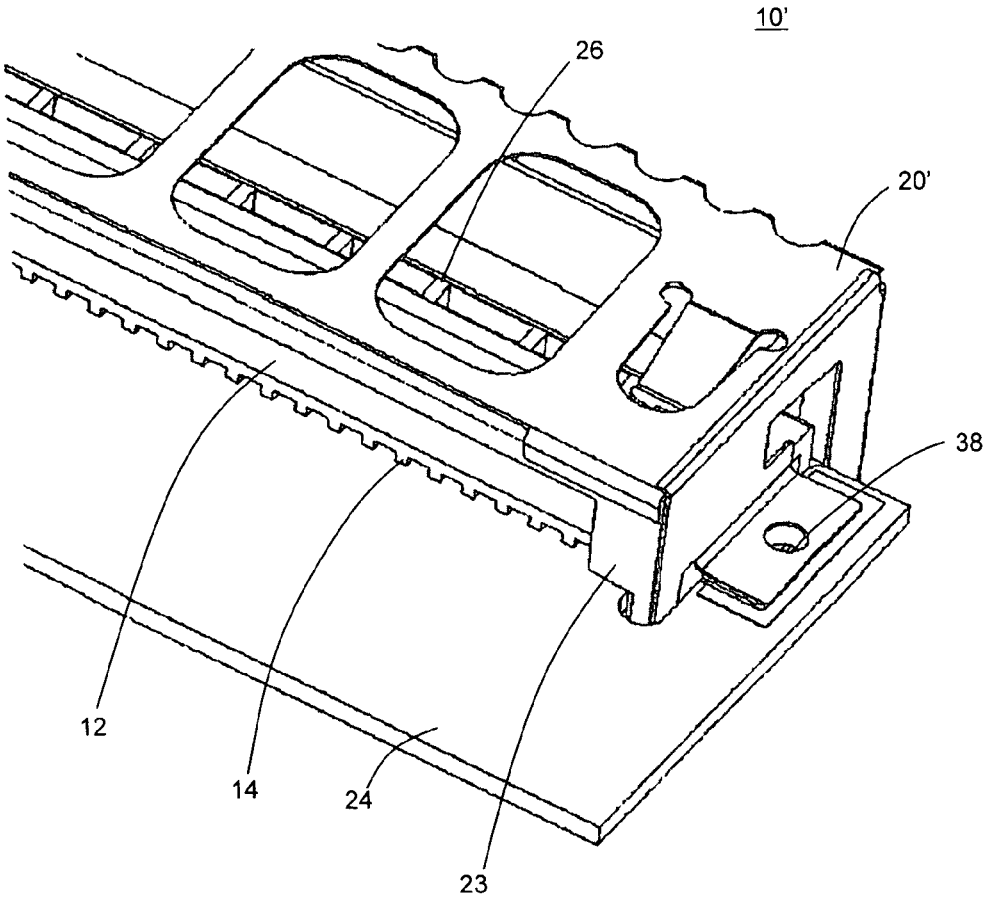
FIG. 9 is a close-up view of another modification of the connector assembly according to another alternative preferred embodiment of the present invention.

In an alternative preferred embodiment shown in FIG. 9, instead of using the flange 17, the connector assembly 10' can be secured to the circuit board 24 by a thru hole screw type connection 38 in the cover 20'. Also, a beam could be soldered to or snapped in a hole in the circuit board 24 for securing the flange to the circuit board.

Figure 10:
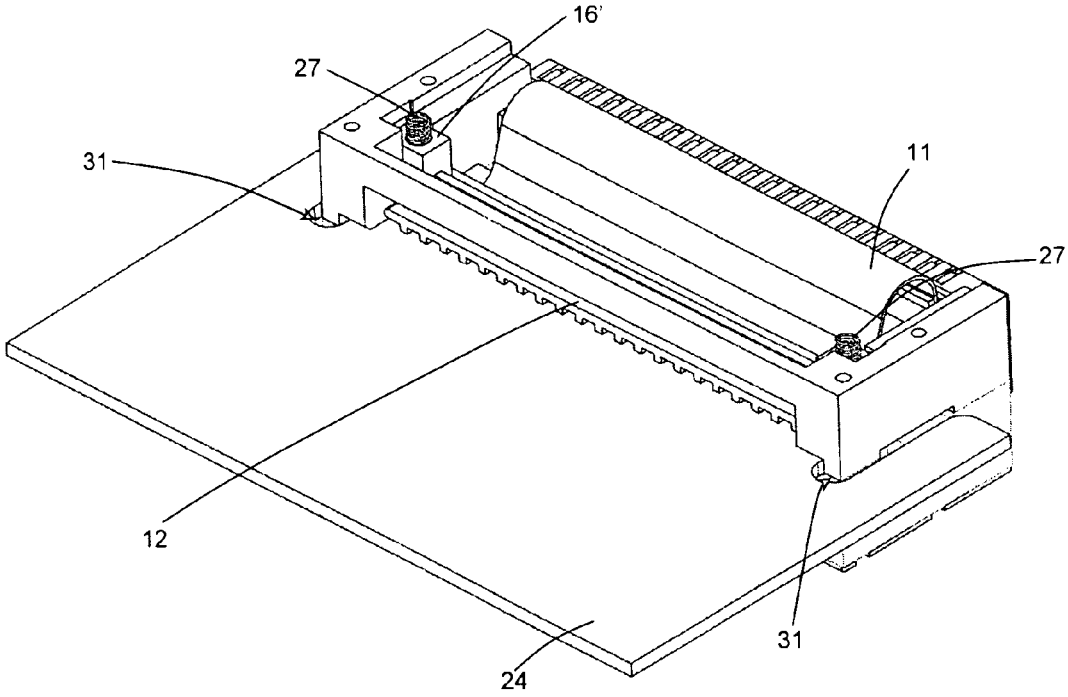
FIG. 10 is an isometric view of still another modification of the connector assembly according to another alternative preferred the first preferred embodiment of the present invention.

As shown in the alternative preferred embodiment of FIG. 10, springs 27 could be used instead of the cantilevers 19. The springs 27 are arranged between the cover (not shown) and the guide blocks 16' of the first and second stiffeners to provide a force normal to the surface of the circuit board 24.

Figure 11A:
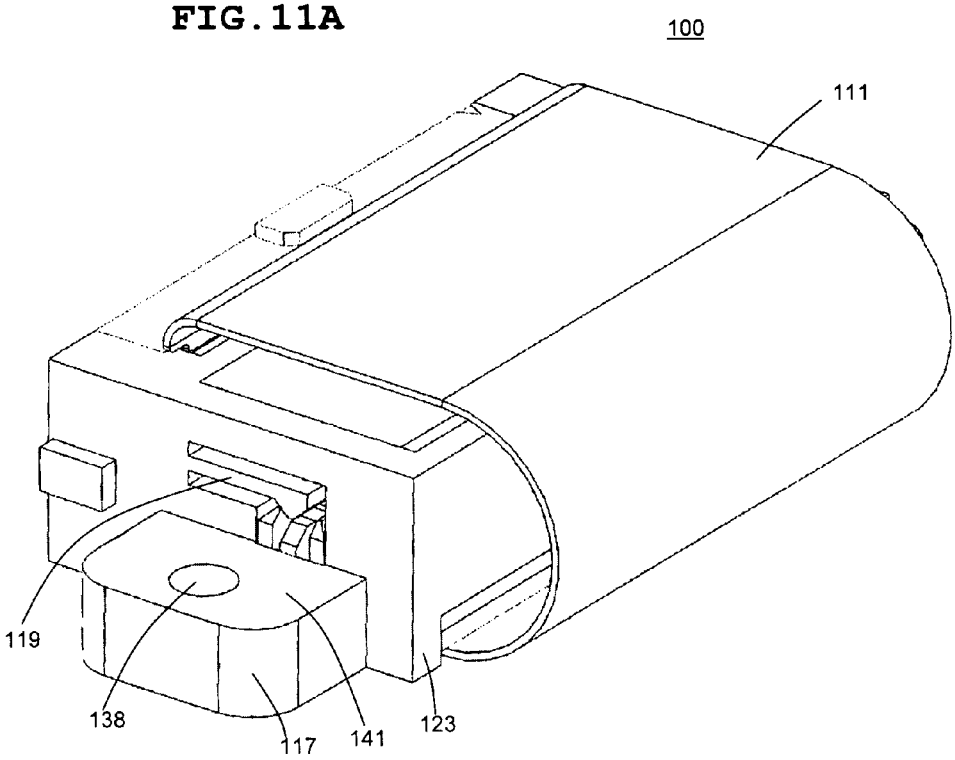
FIGS. 11A and 11B are top and bottom, respectively, isometric views of a connector assembly according to an additional preferred embodiment of the present invention.
Figure 11B:
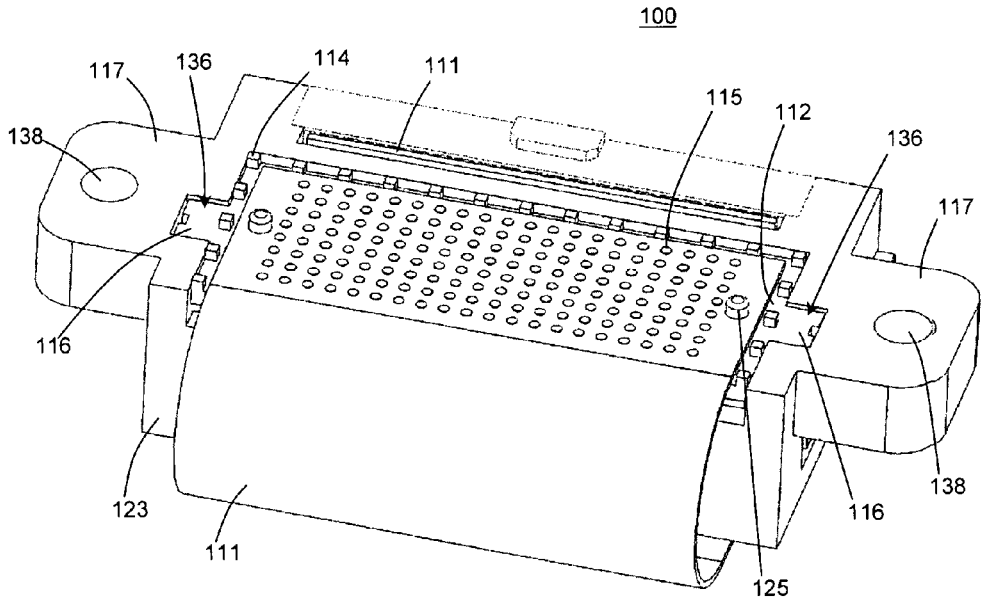
Figure 11C:
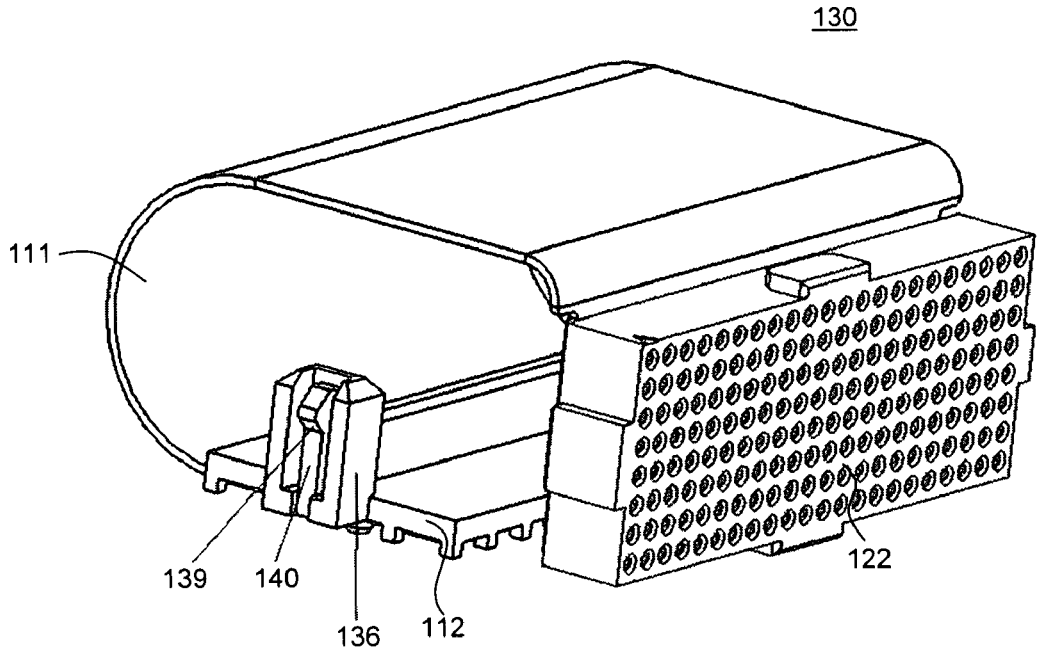
FIG. 11C is an isometric view of a connector subassembly included in the connector assembly of FIGS. 11A and 11B according to the additional preferred embodiment of the present invention.

FIGS. 11A, 11B and 11C show a connector assembly 100 according to yet another preferred embodiment of the present invention. The connector assembly 100 of FIGS. 11A–11C is preferably for use with a backplane connector system. In the preferred embodiment of the present invention shown in FIGS. 11Aa–11C, a connector subassembly 130 includes a single stiffener 112 attached to one end of a flexible circuit 111 and an electrical connector 122 attached the other end of the flexible circuit 111. The connector subassembly 130 can be inserted into a connector frame 123. Guide blocks 116 of the stiffener 112 are placed in the in the block guides 136 of the connector frame 123. The stiffener 112 is retained in the guide blocks 136 by a latch foot 139 of the latch beam 140 (shown in FIG. 11C, which is accomplished when the latch foot 139 is deflected inwardly by contact with the block guides 136 and eventually snaps over an upper surface 141 of the flange 117.

The stiffener 112 includes standoffs 114 for maintaining a minimum distance between the stiffener 112 and a circuit board (not shown). The stiffener 112 also includes alignment pins 125 for aligning fusible conductive elements 115 on the flexible circuit 111 with corresponding conductive pads (not shown) on a circuit board. As discussed above with respect to the first and the second stiffeners 12 and 13 in the first preferred embodiment, the stiffener 112 is arranged to float in the connector frame 123.

The connector frame 123 includes the flanges 117 for attaching the connector assembly 100 to a circuit board. The connector assembly 100 is preferably attached to the circuit board with a screw (not shown) engaging thru holes 138 in the flanges 117 and thru holes (not shown) in the circuit board. Other suitable connections between the circuit board and the connector assembly 100 are also possible.

Once the connector assembly 100 is attached to the circuit board in a surface-mount manner, the connector assembly 100 undergoes a reflow process. The fusible conductive elements 115, preferably solder balls, extend below the standoffs 114 on the stiffener 112 before the connector assembly 100 is subjected to the reflow process. When the force of the cantilevers 119 is applied to the stiffener 112 during the reflow process, the solder balls 115 will become molten and drop down until the standoffs 114 stop the stiffener 112 from going too far which would allow for the stiffener 112 to come too close to the PCB and flatten the solder balls 115. That is, attaching the connector assembly 100 to a circuit board is more forgiving because of the use of solder balls 115. Other aspects and features of this connector assembly 100 are the same as that of the connector assembly 10 shown in FIGS. 1–3.

It should be understood that the foregoing description is only illustrative of the present invention. Various alternatives and modifications can be devised by those skilled in the art without departing from the present invention. Accordingly, the present invention is intended to embrace all such alternatives, modifications and variations which fall within the scope of the appended claims.

What is claimed is:

1. An electrical connector assembly for providing an electrical connection to a circuit board, comprising:

a flexible circuit having a first end for connecting to one major surface of the circuit board and a second end for connecting to another major surface of the circuit board; and an electrical connector connected to the flexible circuit in between the first and the second ends of the flexible circuit; and a cover arranged to surround the flexible circuit and the electrical connector; wherein the cover includes at least one cantilever for pressing the first end of the flexible circuit towards the one major surface of the circuit board or pressing the second end of the flexible circuit towards the another major surface of the circuit board.

2. An electrical connector assembly according to claim 1, wherein the flexible circuit is a flexible printed circuit having fusible contact members thereon.

3. An electrical connector assembly according to claim 1, further comprising solder balls attached to the flexible circuit for connecting the flexible circuit to the circuit board.

4. An electrical connector assembly according to claim 1, wherein the force applied by the at least one cantilever is approximately zero after reflow of the solder balls.

5. An electrical connector assembly according to claim 1, further comprising a connector frame having circuit board guides for guiding the circuit board.

6. An electrical connector assembly according to claim 1, wherein the cover has a hole therein and a bolt is disposed in the hole to connect the cover to the circuit board.

7. An electrical connector assembly according to claim 1, wherein the cover includes at least one cantilever for providing a force to at least one of a first stiffener attached to the first end of the flexible printed circuit and a second stiffener attached to the second end of the flexible printed circuit.

8. An electrical connector assembly according to claim 1, wherein the cover is made of one of metal and plastic.

9. An electrical connector assembly according to claim 1, further comprising compression connectors attached to the flexible circuit for connecting the flexible circuit to the circuit board.

10. An electrical connector assembly according to claim 1, wherein the electrical connector provides a connection that is substantially perpendicular to one major surface of the circuit board.

11. A mezzanine connector including the electrical connector assembly according to claim 1.

12. A backplane connector including the electrical connector assembly according to claim 1.

13. An electrical connector assembly according to claim 1, further comprising:

a first stiffener attached to the first end of the flexible printed circuit; and a second stiffener attached to the second end of the flexible printed circuit.

14. An electrical connector assembly according to claim 13, wherein at least one of the first and the second stiffeners includes blocks which locate and guide the respective stiffener in a connector frame.

15. An electrical connector assembly according to claim 13, wherein at least one of first and second stiffeners includes at least one pin for insertion into a corresponding alignment hole in the circuit board.

16. An electrical connector assembly according to claim 13, wherein at least one of the first and the second stiffeners includes a standoff for engaging a major surface of the circuit board and for maintaining a minimum distance between the stiffener and the circuit board.

17. An electrical connector assembly according to claim 13, further comprising at least one spring for providing a force to one of the first stiffener and the second stiffener.

18. An electrical connector assembly according to claim 13, further comprising a connector frame for holding the first and the second stiffeners and the flexible circuit and the electrical connector that is connected to the flexible circuit in between the first and the second ends of the flexible circuit.

19. An electrical connector assembly according to claim 18, wherein the connector frame includes at least one spreader for spacing the first and the second stiffeners apart until deflected by the circuit board.

20. An electrical connector assembly according to claim 18, wherein the flexible circuit and the first and the second stiffeners are free to float within the connector frame when the first end of the flexible circuit is connected to the one major surface of the circuit board and the second end of the flexible circuit is connected to the another major surface of the circuit board.

21. An electrical connector assembly according to claim 1, wherein the cover includes at least one flange or at least one bolt for connecting the cover to the circuit board.

22. An electrical connector assembly according to claim 21, wherein the at least one flange is soldered to the circuit board.

23. An electrical connector assembly for providing an electrical connection to a circuit board, comprising:

a flexible circuit having a first end for connecting to one major surface of the circuit board and a second end for connecting to another major surface of the circuit board; and an electrical connector connected to the flexible circuit in between the first and the second ends of the flexible circuit; and a connector frame arranged to hold the flexible circuit and the electrical connector; wherein the connector frame includes at least one spreader for spacing the first and the second stiffeners apart until deflected by the circuit board.

* * * * *